US011873140B2

(12) United States Patent
Romera Formiguera

(10) Patent No.: US 11,873,140 B2
(45) Date of Patent: Jan. 16, 2024

(54) BIODEGRADABLE STOPPER

(71) Applicant: PUJOLASOS, S.L., Sant Pere de Torello (ES)

(72) Inventor: Gal•la Romera Formiguera, Barcelona (ES)

(73) Assignee: PUJOLASOS, S.L., Sant Pere de Torello (ES)

( * ) Notice: Subject to any disclaimer, the term of this patent is extended or adjusted under 35 U.S.C. 154(b) by 14 days.

(21) Appl. No.: 17/627,640

(22) PCT Filed: Jul. 6, 2020

(86) PCT No.: PCT/ES2020/070434

§ 371 (c)(1),
(2) Date: Jan. 14, 2022

(87) PCT Pub. No.: WO2021/014037

PCT Pub. Date: Jan. 28, 2021

(65) Prior Publication Data

US 2022/0289433 A1 Sep. 15, 2022

(30) Foreign Application Priority Data

Jul. 19, 2019 (ES) ..... 201931245

(51) Int. Cl.
*B65D 41/22* (2006.01)
*A45D 34/02* (2006.01)
(Continued)

(52) U.S. Cl.
CPC ..... *B65D 41/22* (2013.01); *A45D 34/02* (2013.01); *B65D 39/0058* (2013.01);
(Continued)

(58) Field of Classification Search
CPC ..... B65D 41/0442; B65D 41/045; B65D 41/0435; B65D 41/225; B65D 41/22;
(Continued)

(56) References Cited

U.S. PATENT DOCUMENTS 4,065,018 A * 12/1977 Megowen ..... B65D 51/1688 215/231
4,106,656 A * 8/1978 Babiol ..... B65D 39/16 222/563
(Continued)

FOREIGN PATENT DOCUMENTS

BE 773861 A 1/1972
BE 847137 A * 1/1977 ..... B65D 39/16
(Continued)

OTHER PUBLICATIONS

International Search Report for related patent application PCT/ES2020/070434 issued by the European Patent Office dated Nov. 11, 2020, official translated document enclosed.
(Continued)

*Primary Examiner* — Robert J Hicks
(74) *Attorney, Agent, or Firm* — Hassan Abbas Shakir; Shakir Law PLLC

(57) ABSTRACT

The invention relates to a biodegradable stopper comprising a casing of rigid biodegradable material, consisting of an annular body with a covered flank, and an internal ring of biodegradable elastic material the total width of which is equal to or smaller than the internal width of the annular body, comprising one or more internal recesses in which one or more portions of the ring fit.

13 Claims, 2 Drawing Sheets

(51) Int. Cl.

| | |
|---|---|
| ***B65D 39/00*** | (2006.01) |
| ***B65D 39/16*** | (2006.01) |
| ***B65D 65/46*** | (2006.01) |
| ***B65D 39/06*** | (2006.01) |
| *A45D 34/00* | (2006.01) |

(52) U.S. Cl.
CPC ..... *B65D 39/06* (2013.01); *B65D 65/466* (2013.01); *A45D 2034/007* (2013.01)

(58) Field of Classification Search
CPC ..... B65D 51/1661; B65D 51/1633; B65D 51/16; B65D 39/0052; B65D 39/0058; B65D 39/16; B65D 39/0088; B65D 39/02; B65D 65/466; B65D 65/46; B65D 2543/00546; B65D 2205/00
USPC ..... 220/287, 804, 801, 806, 366.1, DIG. 30; 215/364, 363, 356, 355, 352, 341, 310, 215/307; 217/110
See application file for complete search history.

(56) References Cited

U.S. PATENT DOCUMENTS

| | | | | |
|---|---|---|---|---|
| 2016/0347512 | A1 | 1/2016 | Horner | |
| 2019/0382173 | A1* | 12/2019 | Knight | B65D 55/028 |
| 2020/0031529 | A1* | 1/2020 | Van Goolen | B65D 39/088 |

FOREIGN PATENT DOCUMENTS

| | | | | | |
|---|---|---|---|---|---|
| EP | 1790583 | A1 | | 5/2007 | |
| FR | 870676 | A | | 3/1942 | |
| GB | 272095 | A | | 6/1927 | |
| GB | 365950 | A | | 1/1932 | |
| TW | 201111240 | A | * | 4/2011 | B65D 39/0052 |
| WO | 2004087515 | A1 | | 10/2004 | |

OTHER PUBLICATIONS

Written Opinion of the International Searching Authority for related patent application PCT/ES2020/070434 issued by the European Patent Office dated Nov. 11, 2020, official translated document enclosed.

Arguments by applicant for Art. 34 amendments for related patent application PCT/ES2020/070434 made by applicant made Feb. 22, 2021, in English, dated receipt enclosed.

* cited by examiner

BIODEGRADABLE STOPPER

OBJECT OF THE INVENTION

The object of the present application of invention is to provide a stopper which, due to the particular configuration of the components thereof, the materials used for manufacture thereof can be biodegradable, which results in a significant advantage against the stoppers used up to now.

BACKGROUND OF THE INVENTION

Stoppers are known in the market with wooden casings and an annular plastic component inside, normally used as high-end decorative stoppers in the perfumery field. Plastic is the material used for the annular component as a micrometric adjustment is needed between the stopper and the flask or bottle, so that they do not come off easily, while the user can separate them without difficulty. Wood could not be used with the same purpose as plastic due to the expansions it undergoes. By contrast, cork, being elastic, can be designed with the adequate measurements to assimilate the expansions it may undergo. However, the attachment methods used up to now between cork and the corresponding wooden casing consist of the use of non-biodegradable adhesives, which make the stoppers more complex to recycle.

It is known from BE 773 861 a stopper for connecting ends of tube members comprising an outer casing and internal ring. This stopper can be used for closing hermetically bottles or like.

Therefore, there is still need for a stopper that is biodegradable, economic to manufacture, robust in the use thereof and stylish in the appearance thereof. The present invention helps to solve the existing deficit.

DESCRIPTION OF THE INVENTION

The biodegradable stopper prepared with natural raw material of the present invention is made up of a casing of rigid biodegradable material, consisting of an annular body covered on one of the sides, as well as an internal ring of biodegradable elastic material. The stopper is characterised in that the annular body of the casing comprises one or more internal recesses in which one or more portions of the ring fit.

Thanks to this configuration of the casing and the ring, a stopper is obtained with an elastic internal component suitable to be fixed around the neck of a bottle or flask, and with a casing that provides the stiffness to the ring so that it does not deform, characterised in that the use of adhesives to keep both components attached is not needed. This kind of stopper is suitable for applications wherein the resistance that the stopper must offer is less than that necessary to cover beverage bottles, such as for example for the decoration of perfumery flasks. Since the stopper is configured to be placed around the neck of a bottle and not inside it, the attachment force between the components of the stopper may be performed without the need for adhesives. Therefore, as only biodegradable materials are used in the manufacture thereof, the whole stopper is biodegradable. By way of example, the rigid material may be wood and the elastic material may be cork, preferably of the agglomerated type. These two organic materials are suitable for use thereof even in the food industry.

In a possible embodiment, the casing only may comprise a perimeter internal recess, of a depth equal to or smaller than the thickness of the ring, wherein an external perimeter region of the ring fits preferably without any gaps.

In another possible embodiment, the ring comprises one or more projections in the external face thereof which fit in the complementary internal recesses of the casing. In this case, the external diameter of the ring can be equal to or minimally smaller than the internal diameter of the casing, such that only the projections exert fixing force between the two components, or the diameter of the ring can be minimally greater, such that the pressure it exerts on the casing contributes to the fixing between the components. In a specific embodiment, the ring may comprise one or several annular projections, while the casing comprises the corresponding annular recesses. And in another alternative embodiment, instead of being projections distributed in the axial direction, they may consist of portions, preferably distributed equidistant from each other, the casing comprising the corresponding complementary internal recesses.

In the preferred case wherein cork is the ring material used, it is necessary for the aforementioned projections and recesses to have such dimensions that they allow the stresses received with the actions of putting the stopper on or removing it from a bottle to be withstood. Specifically, the depth of the recess or recesses must be at least 1 mm and the height at least 2 mm.

Preferably, in order to avoid the generation of excessive pressures or vacuum during the action of putting a stopper on or removing it from a bottle respectively, the ring may comprise in the internal face thereof one or more projections which extend between the two flanks thereof. Alternatively or in a complementary way and with the same purpose, the ring may comprise in the internal face thereof one or more grooves that extend between the two flanks thereof. Thanks to the air passage channel generated by these projections and/or grooves, it is easier to put the stopper on or remove it. In the preferred case wherein cork is the ring material, it is necessary for these projections and/or grooves to have such dimensions that they prevent the air channel from getting blocked when the ring is trapped against the bottle. Specifically, the dimension in radial direction of the projections of the internal face of the ring must be at least 0.5 mm, equal to the width thereof, and in the case of the grooves, the depth must be at least 0.5 mm, equal to the width thereof.

In order to facilitate the introduction of the ring in the casing during the manufacture of the stopper, the flank of the ring that is adjacent to the covered side of the casing may have a bevelled edge. In the same way, if the ring has projections in the external face for fixing thereof to the casing, the edges adjacent to the covered side of the casing may further be bevelled. Furthermore, in order to facilitate the centering of the stopper when placing it in the bottle, the internal edge of the ring which is adjacent to the open side of the casing may be rounded or bevelled.

It should be noted that, even if the internal component is defined as a ring, this may also have a covered side, specifically the one adjacent to the covered side of the casing.

These and other features and advantages of the biodegradable stopper object of the present invention will be evident in light of the description of a preferred, but not exclusive, embodiment which is illustrated by way of non-limiting example in the drawings which are attached.

DETAILED DESCRIPTION OF POSSIBLE EMBODIMENTS

Figure 1:
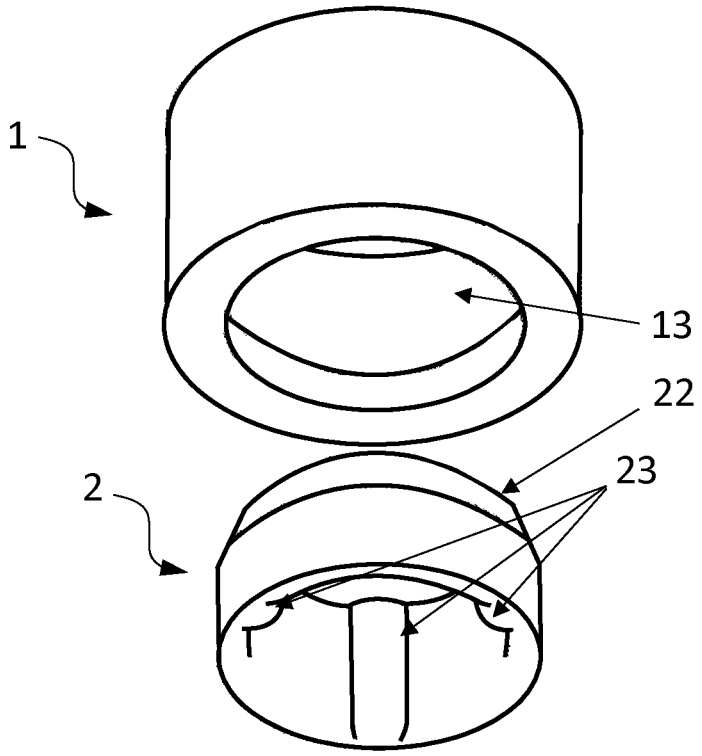
FIG. 1 is a perspective exploded view of a first embodiment of the biodegradable stopper.
Figure 2:
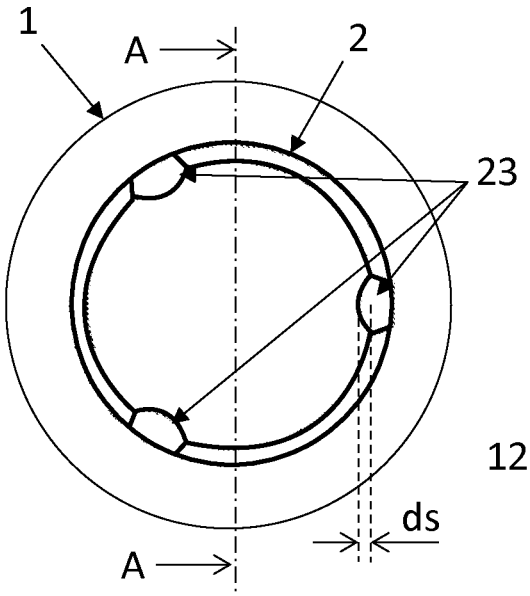
FIG. 2 is a lower plan view of the biodegradable stopper.
Figure 3:
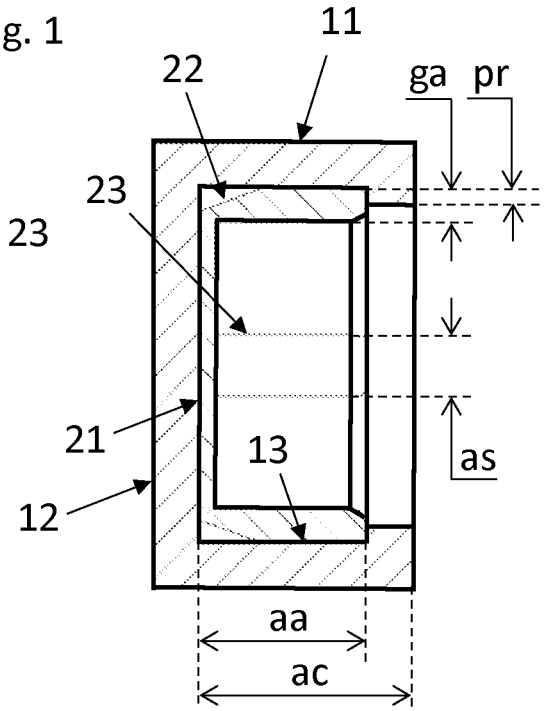
FIG. 3 is a cross-sectional view of the A-A cut of FIG. 2.

As shown in FIGS. 1 to 3, a first exemplary embodiment of the present biodegradable stopper consists of a wooden casing (1) made up of an annular body (11) with a covered side (12), as well as an internal cork ring (2), also with a covered side (21) and the external edge (22) of which is bevelled, wherein the annular body (11) comprises a perimeter internal recess (13) in which only one portion of the ring (2) fits, given that the thickness (ga) of the ring (2) is greater than the depth (pr) of the recess (13). As can be seen, in this embodiment, the total width (aa) of the ring (2) is equal to that of the recess (13), and therefore is smaller than the internal width (ac) of the annular body (11). In turn, the ring (2) of this embodiment comprises three projections (23) in the internal face thereof, which extend between the two flanks thereof and radially within. In this specific case, the dimension in radial direction (ds) of the projections (23) of the internal face of the ring (2) is 3 mm and the width (as) thereof is 1 cm.

Figure 4:
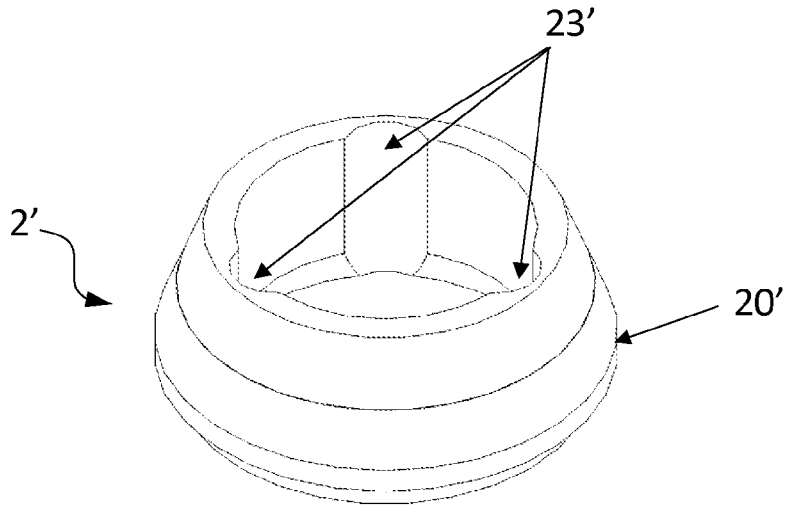
FIG. 4 is a perspective view of the ring of a second embodiment of the stopper.
Figure 5:
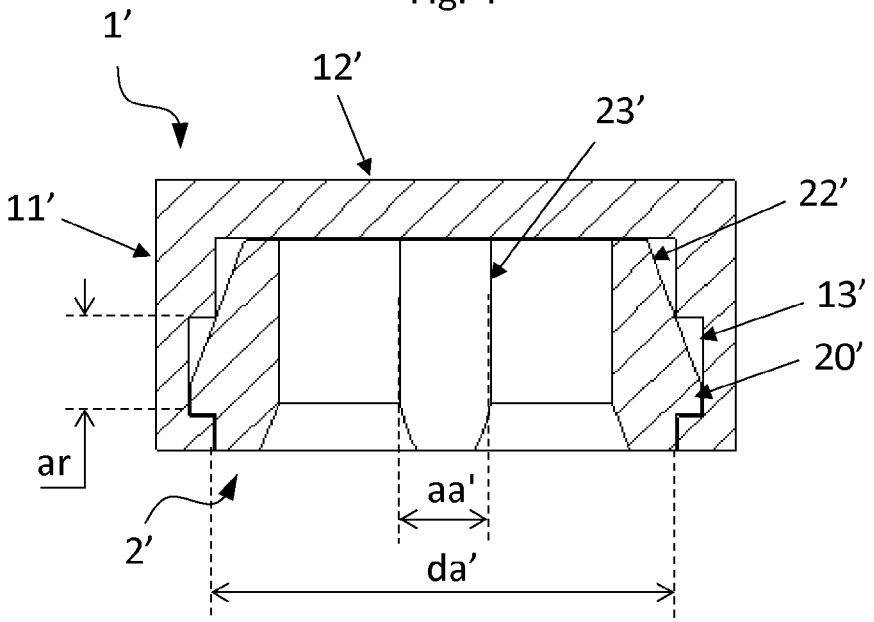
FIG. 5 is a cross-sectional view of a middle plane of the second embodiment of the stopper.

In a second exemplary embodiment, shown in FIGS. 4 and 5, the biodegradable stopper further consists of a wooden casing (1) made up of an annular body (11) with a covered flank (12), as well as of an internal cork ring (2) with the flanks uncovered. As can be seen, in this exemplary case, the total width of the ring (2') is equal to the internal width of the annular body (11'), and the flank adjacent to the covered side of the casing (1') has a bevelled external edge (22'). Likewise, the external diameter (da') of the ring (2') is equal to the internal diameter of the casing (1'). In this embodiment, the ring (2') comprises an annular projection (20') bevelled at the top and the casing (1') comprises a perimeter internal recess (13') in which said annular projection (20') fits, the width (ar) of the recess (13') being 1.6 cm. In turn, the ring (2') of this embodiment comprises in the internal face thereof three grooves (23') which extend between the two flanks thereof, by way of air passage channel, the width (aa') of which is of 1 cm and the depth of which is of 3 mm.

The details, shapes, dimensions and other accessory elements of the present invention may be conveniently replaced by others that are technically equivalent without departing from the scope defined by the claims included below.

What is claimed is:

1. A biodegradable stopper comprising:

a casing of a rigid biodegradable material, and the casing comprising an annular body with a covered flank, and an internal ring of biodegradable elastic material, a total width (aa) of which is equal to or smaller than an internal width (ac) of the annular body, the annular body comprising one or more internal recesses in which one or more portions of the ring fit, wherein the ring comprises in the internal face thereof an air passage channel generated by one or more projections or grooves which extend between two flanks of the ring thereof.

2. The stopper according to claim 1, wherein the internal recess of the casing is annular, having a depth (pr) equal to or smaller than a thickness (ga) of the ring, such that an external perimeter region of the ring fits therein.

3. The stopper according to claim 1, wherein the ring comprises one or more projections in the external face thereof which fit in the internal recesses, which are complementary to said projections.

4. The stopper according to claim 3, wherein one or several projections of the ring are annular projections, the internal recesses of the casing being complementary to said annular projections.

5. The stopper according to claim 3, wherein an edge of the annular projections which is adjacent to the covered side of the casing is beveled.

6. The stopper according to claim 1, wherein the biodegradable elastic material of the ring is cork.

7. The stopper according to claim 6, wherein a depth (pr) of the internal recess or recesses of the casing is at least 1 mm and a width (ar) is at least 0.5 mm.

8. The stopper according to claim 6, wherein a dimension in radial direction (ds) of the projection or projections of the internal face of the ring is at least 0.5 mm, equal to a width (as) thereof.

9. The stopper according to claim 6, wherein the depth of the one or the several grooves of the internal face of the ring is of at least 0.5 mm, equal to the width thereof.

10. The stopper according to claim 1, wherein the flank of the ring which is adjacent to the covered side of the casing comprises an external beveled edge.

11. The stopper according to claim 1, wherein the internal edge of the ring which is adjacent to the open side of the casing is rounded or beveled.

12. The stopper according to claim 1, wherein a flank of the ring which is adjacent to the covered side of the casing is a covered flank.

13. The stopper according to claim 1, wherein the rigid biodegradable material of the casing is wood.

* * * * *